US011533792B2

(12) United States Patent
Kuchler et al.

(10) Patent No.: US 11,533,792 B2
(45) Date of Patent: Dec. 20, 2022

(54) MICROWAVE COOKING DEVICE HAVING A PATCH ANTENNA

(71) Applicant: BSH Hausgeräte GmbH, Munich (DE)

(72) Inventors: Markus Kuchler, Gstadt am Chiemsee (DE); Kerstin Rigorth, Mühldorf (DE); Sebastian Sterz, Großaitingen (DE)

(73) Assignee: BSH Hausgeräte GmbH, Munich (DE)

( * ) Notice: Subject to any disclaimer, the term of this patent is extended or adjusted under 35 U.S.C. 154(b) by 612 days.

(21) Appl. No.: 16/490,615

(22) PCT Filed: Jun. 8, 2018

(86) PCT No.: PCT/EP2018/065161
§ 371 (c)(1),
(2) Date: Sep. 3, 2019

(87) PCT Pub. No.: WO2018/234064
PCT Pub. Date: Dec. 27, 2018

(65) Prior Publication Data

US 2020/0015327 A1 Jan. 9, 2020

(30) Foreign Application Priority Data

Jun. 20, 2017 (DE) ..... 102017210275.6

(51) Int. Cl.
*H05B 6/72* (2006.01)
*H05B 6/64* (2006.01)

(52) U.S. Cl.
CPC ..... *H05B 6/72* (2013.01); *H05B 6/6444* (2013.01)

(58) Field of Classification Search
CPC ..... H05B 6/6444; H05B 6/70; H05B 6/72; A61K 31/4745; A61K 45/06; C07K 14/4748; C12Q 1/6886; C12Q 2600/106; C12Q 2600/136; C12Q 2600/156; C12Q 2600/172
USPC ..... 219/702, 704, 745–751, 761, 690, 694, 219/695, 697; 330/295; 331/107 R, 295
See application file for complete search history.

(56) References Cited

U.S. PATENT DOCUMENTS 4,335,290 A 6/1982 Teich
5,558,800 A 9/1996 Page et al.
5,981,928 A 11/1999 Lee
(Continued)

FOREIGN PATENT DOCUMENTS

DE 102015109685 A1 12/2016
WO 2011070765 A1 6/2011

OTHER PUBLICATIONS

International Search Report PCT//EP2018/065161 dated Sep. 4, 2018.
National Search Report CN 201880041060.4 dated May 7, 2021.

*Primary Examiner* — Quang T Van
(74) *Attorney, Agent, or Firm* — Michael E. Tschupp; Andre Pallapies; Brandon G. Braun

(57) ABSTRACT

A microwave cooking appliance includes a cooking chamber delimited by a cooking chamber wall, and a microwave apparatus configured to introduce microwaves into the cooking chamber. The microwave apparatus includes a patch antenna having a planar base body and a planar emission body, which are electrically insulated from one another. The emission body is configured to cover the base body at a distance and capable of being fed with microwave energy, with the base body corresponding to a region of the cooking chamber wall.

12 Claims, 3 Drawing Sheets

(56) References Cited

U.S. PATENT DOCUMENTS

| | | | | |
|---|---|---|---|---|
| 9,024,831 | B2 * | 5/2015 | Wang | H01Q 1/241 343/893 |
| 9,192,438 | B2 * | 11/2015 | Thiel | A61B 18/1815 |
| 2012/0160844 | A1 | 6/2012 | Nobue et al. | |
| 2016/0066369 | A1 | 3/2016 | Schulze et al. | |
| 2017/0251530 | A1 | 8/2017 | Dore et al. | |

* cited by examiner

MICROWAVE COOKING DEVICE HAVING A PATCH ANTENNA

CROSS-REFERENCES TO RELATED APPLICATIONS

This application is the U.S. National Stage of International Application No. PCT/EP2018/065161, filed Jun. 8, 2018, which designated the United States and has been published as International Publication No. WO 2018/234064 A1 and which claims the priority of German Patent Application, Serial No. 10 2017 210 275.6, filed Jun. 20, 2017, pursuant to 35 U.S.C. 119(a)-(d).

BACKGROUND OF THE INVENTION

The invention relates to a microwave cooking appliance, having a cooking chamber delimited by a cooking chamber wall and a microwave apparatus for introducing microwaves into the cooking chamber, which has at least one patch antenna, the patch antenna having a planar base body and a planar emission body, which covers the base body at a distance and can be fed with microwave energy, and the base body and the emission body being electrically insulated from one another. The invention can be advantageously applied in particular to household appliances, in particular standalone microwave appliances or ovens with microwave functionality.

WO 2016/043731 A1 discloses a microwave cooking appliance, which has a cooking chamber, which is arranged to hold a load, at least two patch antennas, which are coupled to at least one microwave generator, and a control unit. Each of the at least two patch antennas is configured in such a manner that it can emit microwaves into a predefined direct heating zone within the cooking chamber close to the respective patch antenna. The control unit is configured in such a manner that it selects energy levels for each of the at least two patch antennas, as if the load were static and as if there were no interference between the at least two patch antennas. This has the disadvantage that the simple patch antennas used only have a small feed bandwidth.

U.S. Pat. No. 5,558,800 discloses a microwave power emitter for microwave heating applications. It is disclosed here that output adjustment networks, which are normally contained in a microwave power transistor package, and a transistor combination network for this are eliminated for heating applications, for example in microwave ovens. In one variant the transistor dies of four microwave silicon bipolar transistors are connected directly to low impedance points of a common patch antenna element, also referred to as applicators, and are arranged in the wall of a cooking chamber instead of a magnetron. Each pair of power transistors is electrically at a distance of half a wavelength and arranged perpendicular to one another on the antenna. The transistors are operated in pairs with a phase difference of 200°, so that mutually orthogonal longitudinal modes are excited in the antenna. The transistors are also frequency-modulated above their prescribed frequency band to eliminate standing waves in the load, in other words in the object or substance being heated or cooked. Either one or more patch antennas can be used and operated, for example with two different frequencies permitted for heating applications, typically 915 MHz and 2450 MHz. This also has the disadvantage that the patch antenna used only has a small feed bandwidth.

US 2016/066369 A1 combines a microwave radiation feed by way of hollow conductors with a light source. A hollow conductor opening is separated from a cooking chamber by a cover, e.g. borosilicate glass, here. Next to the hollow conductor, and therefore outside the microwave field, is a lighting facility, the light source of which is also positioned behind the cover through an opening, thereby lighting the cooking chamber through the glass. It must be ensured here however that the lighting facility is positioned outside the hollow conductor cross section so that it is not exposed to excessive microwave radiation or does not cause the microwave radiation to be deflected in an unfavorable manner.

It is the object of the present invention to overcome the disadvantages of the prior art to some extent at least and in particular to provide a microwave cooking appliance, which can feed microwaves with a larger bandwidth into the cooking chamber in a simple and economical arrangement.

BRIEF SUMMARY OF THE INVENTION

This object is achieved according to the features of the independent claims. Preferred embodiments will emerge in particular from the dependent claims.

The object is achieved by a microwave cooking appliance, having a cooking chamber delimited by a cooking chamber wall and a microwave apparatus for introducing microwaves into the cooking chamber, the microwave apparatus having at least one patch antenna, the patch antenna having a planar base body and a planar emission body, which covers the base body at a distance and can be fed with microwave energy, the base body and the emission body being electrically insulated from one another and the base body corresponding to a region of the cooking chamber wall.

This microwave cooking appliance has the advantage that the patch antenna has a particularly simple, robust and economical structure and can also feed microwaves with a relatively large bandwidth into the cooking chamber.

The microwave cooking appliance can be a simple microwave or a microwave combination appliance, for example a cooking appliance that is or has an oven with a microwave function. The microwave cooking appliance is in particular a household appliance.

The microwave apparatus can have a microwave generator (e.g. a magnetron) and at least one microwave line leading to the at least one patch antenna.

In one development the (sub-)region of the cooking chamber wall, which forms the base body, is a flat sub-region of the cooking chamber wall. The base body is electrically conductive and is at a predefined reference potential. The base body can in particular serve as ground.

The microwave radiation is emitted by way of the emission body. The emission body is also electrically conductive. A frequency of the microwaves can comprise for example 915 MHz or 2.45 GHz.

A planar body can refer in particular to a body, which has a marked or non-negligible lateral extension (i.e. height and width) when the cooking chamber wall is viewed from above. That the patch antenna has a planar base body and a planar emission body, which covers the base body at a distance, therefore means that there is a hollow space between the base body and the emission body.

In one development the emission body is a plate-type emission body. The emission body can in particular be a flat emission body. The emission body can also be referred to as a patch or resonator. In a particularly simple embodiment the emission body has a rectangular shape when viewed from above, it being possible for the corners to be rounded to avoid field elevations and associated flashovers. However any other surface shape is also conceivable, it being possible for the emission body to have openings or incisions. The emission body can therefore generally be an unperforated or perforated (e.g. slotted) body.

The cooking chamber wall and the emission body are electrically conductive. They can be made of metal, in particular metal sheet. The cooking chamber wall and/or the emission body can be coated. The cooking chamber wall can also be referred to as a muffle.

In one embodiment the base body corresponds to a recess in the cooking chamber wall, the emission body is inserted into the recess and the base body and emission body are insulated electrically from one another by a peripheral gap. This results in a compact patch antenna which is particularly easy to produce.

In one development the recess is embossed or indented. Alternatively it can be cut out of the material or can be a separately produced part of the cooking chamber wall that is then inserted.

The gap is in particular a gap that runs peripherally when the recess is viewed from above. The gap can in particular have a practically constant gap width.

In one development the gap is an air gap.

In a further embodiment the gap is closed or sealed by means of an electrically insulating closing material. Use of the closing material has the advantage that the gap is bridged mechanically and the emission body can be positioned stably and fastened as a result. The hollow space between base body and emission body is therefore also advantageously protected from dirt and/or other environmental influences and is also subject to less thermal stress.

In one development only the gap is closed or sealed by means of an electrically insulating closing material, not the surface of the emission body on the cooking chamber side.

In an alternative embodiment the closing material covers the gap and at least a partial surface of the emission body, in some instances also the cooking chamber wall adjoining the gap outside the patch antenna, on the cooking chamber side. This can allow particularly easy application of the closing material, e.g. economically with a general cooking chamber coating. The cooking chamber side surface of the emission body can thus also be protected and/or used functionally. It also allows particularly easy cleaning. It also allows the visual appearance of the patch antenna to be matched particularly easily to the remainder of the cooking chamber wall.

In one development the closing material only covers the gap and the cooking chamber side surface of the emission body in the manner of a coating. This allows the cooking chamber side surface of the emission body to be lowered according to the thickness of the closing material there, so the patch antenna is again arranged flush with the surrounding wall or the patch antenna is embedded flush in the cooking chamber wall or the surrounding wall.

In a further embodiment the closing element is glass or glass ceramic. This has the advantage that the closing material is particularly mechanically, chemically and thermally resistant. In particular the closing material can then withstand typical oven temperatures, for example up to 300° C. The closing material can also withstand typical pyrolysis temperatures of 450° C. or more without damage when used in a pyrolysable oven with microwave functionality.

In one development the volume or hollow space between the base body and the emission body is filled with electrically insulating, in particular temperature-resistant, sealing material such as glass wool or ceramic foam, to achieve better thermal insulation or dielectric strength.

In a further embodiment the gap is closed by means of a light-permeable electrically insulating closing material and the microwave appliance has at least one light source, the light of which can be coupled into the closing material from outside the cooking chamber. This has the advantage that the patch antenna can also serve to light the cooking chamber. This makes use of the effect that light can be emitted in a directed or diffuse manner into the cooking chamber, if the closing material is illuminated by at least one light source, which can be positioned inside or outside the patch antenna.

In one development the at least one light source couples its light into the closing material laterally. The closing material can then act as a light guide and couple the light out again in particular over its entire length or circumference. This provides a large light emission surface for emitting light into the cooking chamber. In order to achieve a particularly regular emission of light into the cooking chamber, the cooking chamber side surface of the closing material can be structured correspondingly, being roughened for example.

The light can be coupled immediately or directly into the closing material in the gap, in particular by a light source positioned on the closing material.

In one development the light is coupled ("indirectly") into the closing material in the gap by way of a lightwave guide or by way of a hollow conductor or an air gap. In other words there is at least one lightwave guide (optical fiber or hollow conductor) or air gap between the closing material in the gap and the light source. This has the advantage that the light source can be positioned further from the patch antenna. It is then possible to insulate the light source thermally from the cooking chamber more easily and it is not exposed to microwave radiation.

In a general development at least one light source is arranged in such a manner that it emits its light into the hollow space between base body and emission body. The light-permeable closing mass in the gap then serves as a light transmission element or window. The light source can be arranged for example in the region of the base body, for example projecting or radiating in through an opening in the base body.

In another embodiment the recess in the cooking chamber wall providing the base body corresponds to a recess in a cooking chamber light. It is then possible for a recess or indentation in the cooking chamber wall provided for lighting purposes also to hold the emission body or patch antenna and the emission body also to seal said space from environmental influences. This allows light to be emitted from the antenna unit onto an optically permeable wall of said space and light thus to be radiated into the cooking chamber.

In another embodiment inner surfaces of the patch antenna facing the hollow space are configured to reflect. This increases coupling out efficiency for light radiated into the hollow space. In particular a surface of the base body delimiting the hollow space can also be configured to reflect. The inner surface(s) can be configured to reflect diffusively and/or to mirror.

In one development the microwave apparatus has a microwave supply, which is coupled to the emission body. This allows microwave energy to be conducted to the emission body. The coupling can be an inductive coupling, a wave coupling, etc. Generally a position in which the inner conductor is coupled to the emission body can be selected such that the most advantageous emission characteristic possible results.

In another embodiment the microwave apparatus has a microwave supply, which is coupled to the emission body capacitively. The capacitive coupling of the antenna in particular advantageously allows a much greater bandwidth to be achieved than with a conventional patch antenna. This allows feeding in with little loss over a larger frequency range. The structural embodiment of the capacitive coupling is essentially not restricted here.

In another embodiment the microwave supply is a coaxial line, e.g. a coaxial cable. The inner conductor of the coaxial line is coupled to the emission body for high frequency purposes. The outer conductor can be connected electrically to the cooking chamber wall or another ground potential. In one development the inner conductor is insulated electrically by the base body and passed further through the hollow space to the emission body. The inner conductor is in particular insulated electrically from the emission body, e.g. by an air gap or by an electrically insulating material or a dielectric material.

In a further embodiment an inner conductor of the coaxial line is inserted freely (in other words not in contact with the emission body) into a sleeve-type holding region of the emission body and an intermediate space between the inner conductor and the sleeve-type holding region is filled with a dielectric material. This has the advantage that the inner conductor can be positioned and fixed in a simple and precise manner and the capacitive coupling is simple to establish. The sleeve-type holding region starts at least at the hollow space side surface or the rear or lower face of the emission body. There is therefore a sleeve-like geometry present on the rear face of the emission body, forming a cylindrical capacitor together with the inner conductor of the coaxial line and the dielectric material in between. The cylindrical capacitor can be passed through to the cooking chamber side surface or front face. Alternatively the inner conductor can be terminated by the dielectric material in the interior of the emission body, the front face of the emission body then forming a continuous plane.

Any other suitable microwave line, e.g. a hollow conductor, a microstrip line, etc., can also be used instead of a coaxial line.

In a further embodiment a number of patch antennas are present on the cooking chamber wall, being aligned with different rotations from one another. Rotation of the patch antennas has the advantage that the polarization direction of the microwaves is also rotated, thereby allowing the transfer of microwaves between the patch antennas to be reduced. In a development that is advantageous for particularly effective suppression of microwave transfer between the patch antennas the patch antennas are rotated through 90° relative to one another.

BRIEF DESCRIPTION OF THE DRAWINGS

The properties, features and advantages of the present invention described above and the manner in which these are achieved will become clearer and more readily comprehensible in conjunction with the schematic description which follows of an exemplary embodiment, which is described in more detail in conjunction with the drawings.

DETAILED DESCRIPTION OF EXEMPLARY EMBODIMENTS OF THE PRESENT INVENTION

Figure 1:
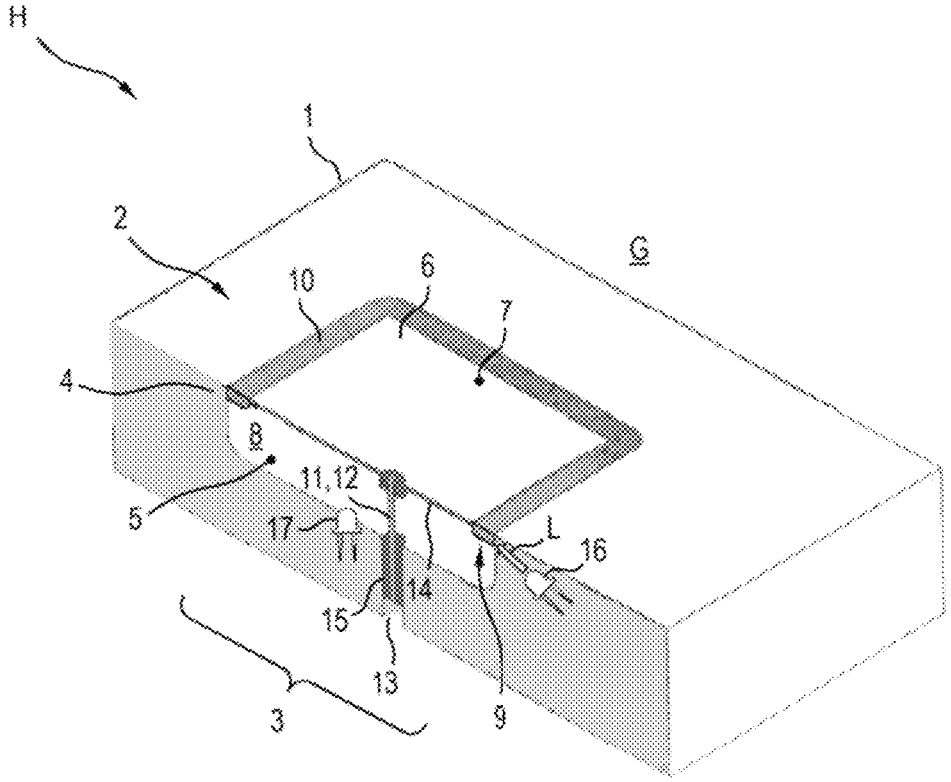
FIG. 1 shows an oblique sectional view of a detail of a cooking chamber wall in the region of a patch antenna according to a first exemplary embodiment.

FIG. 1 shows an oblique sectional view of a detail of a cooking chamber wall 1 of a household cooking appliance H in the region of a patch antenna 2. The patch antenna 2 is in particular built with mirror symmetry along the sectional plane.

The cooking chamber wall 1 delimits a cooking chamber G. The patch antenna 2 has a planar base body 3 in the form of a sub-region of the cooking chamber wall 1, on which a recess 4 is present. The base body 3 therefore corresponds to a region of the cooking chamber wall 1. The recess 4 here is configured as a recess produced by removing material.

A cooking chamber side flat base 5 of the recess 4 is covered by a plate-type emission body ("patch" 6). The patch 6 is inserted into the recess 4 in such a manner that it is arranged with its top face 7 facing the cooking chamber G practically flush with the cooking chamber wall 1. The base body 3 corresponds in particular to a region of the cooking chamber wall 1 below the flat base 5, in some instances also below the side edges of the recess 4.

The base 5 and patch 6 are electrically conductive. They can have corresponding metal regions for this purpose, each having a metal sheet for example. The metal of base 5 and patch 6 can be the same or different. The base 5 and patch 6 can therefore both have steel sheet or be made of steel sheet. Alternatively the base can have steel sheet or be made of steel sheet and the patch 6 can have copper sheet or be made of copper sheet.

The base 5 and patch 6 are arranged parallel to one another. The recess 4 and patch 6 form and delimit a hollow space 8. The base 5 and patch 6 have a basic shape that is rectangular when viewed from above, the corners of which can be rounded.

The edge of the cooking chamber wall 1 delimiting the recess 4 and an edge of the patch 6 are separated from one another by a peripheral rectangular annular gap 9. The annular gap 9 is filled with an electrically insulating closing material 10 in the form of glass or glass ceramic. The base body 3 and patch 6 are therefore insulated electrically from one another, as the hollow space 8 also has an electrically insulating effect. The hollow space 8 can be filled with air or glass wool, etc. to this end.

The patch 6 can be fed with microwave energy. A coaxial cable 11 is used for this purpose, being coupled to a microwave generator (not shown). An inner conductor 12 of the coaxial line 11 is passed through a hole 13 in the base body 3 and on through the hollow space 8 to a rear face 14 of the patch 6. The inner conductor 12 is insulated electrically from the cooking chamber wall 1, to which end an intermediate space between inner conductor 12 and base body 3 is filled with a dielectric material 15. The dielectric material 15 also serves to fix the inner conductor 12 mechanically.

The inner conductor 12 is also insulated electrically from the patch 6, so there is a capacitive coupling for microwaves between said components.

In one variant the closing material 10 is light-permeable. The household appliance H has at least one light source, e.g.

an LED 16, the light L from which can be coupled into the closing material 10 from outside the cooking chamber G. The LED 16 can radiate its light L directly into the closing material 10, for example into a side edge. The closing material 10 then acts as a light guide and distributes the light L around its periphery. The light L is then radiated into the cooking chamber G, in some instances with a portion also being radiated into the hollow space 8. The closing material 10 thus serves to light the cooking chamber.

Alternatively or additionally at least one light source, e.g. an LED 17, can radiate its light directly into the hollow space 8. To this end the LED 17 can be arranged in the region of the base 5 of the recess 4. The closing material 10 then serves as a window for the passage of light into the cooking chamber G.

To increase luminous efficiency the inner surfaces of the patch antenna 2 facing the hollow space 8 can be configured to reflect, e.g. the surface of the recess 4, including the base 5, and/or the rear face 14 of the patch 6.

If there are a number of patch antennas 2 present in the cooking chamber wall 1, in particular in a side of the cooking chamber wall 1, these can be aligned with different rotations from one another when viewed from above.

Figure 2:
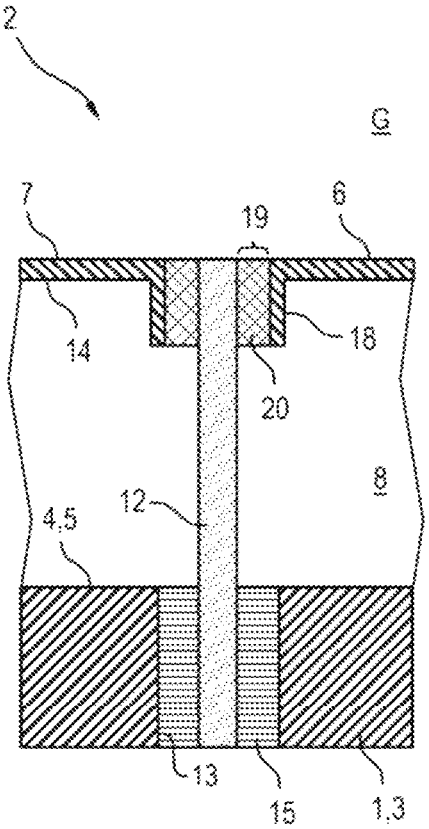
FIG. 2 shows a side sectional view of a first variant of a capacitive coupling of an inner conductor and an emission body of the patch antenna.

FIG. 2 shows a side sectional view of a detail of a first variant of a capacitive coupling of the inner conductor 12 and the patch 6 of the patch antenna 2.

To this end the patch 6 has a tube or sleeve-type holding region 18 projecting backward into the hollow space 8. The holding region 18 here is formed continuously by the patch 6 and therefore opens into the cooking chamber G. The inner conductor 12 is introduced freely into the holding region 18. A tube-shaped intermediate space 19 between the inner conductor 12 and the sleeve-type holding region 18 is filled with a dielectric material 20. This has the advantage that the inner conductor 12 can be positioned and fixed easily and precisely and the capacitive coupling can be established easily. The sleeve-type holding region 18 in particular forms a cylindrical capacitor together with the inner conductor 12 of the coaxial line and the dielectric material 20 in between. The cylindrical capacitor here is passed through to the cooking chamber side surface 7 of the patch 6.

The dielectric materials 15 and 20 can be the same or different.

Figure 3:
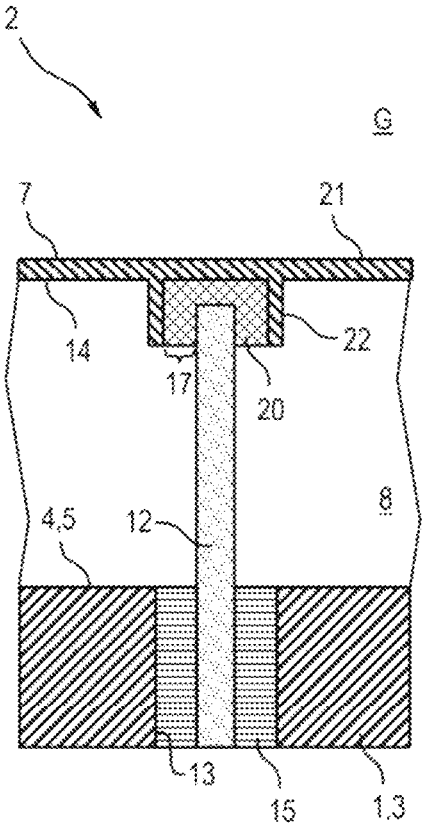
FIG. 3 shows a side sectional view of a second variant of a capacitive coupling of an inner conductor and an emission body of the patch antenna.

FIG. 3 shows a side sectional view of a detail of a second variant of a capacitive coupling of the inner conductor 12 and a patch 21 of a patch antenna 2. The patch 21 is configured in the same manner as the patch 6, but with the sleeve-type holding region 22 not being here but adjoining the plate-type sub-region of the patch 21. The holding region 22 is therefore closed at the front or facing the cooking chamber G. The front face 7 of the patch 21 facing the cooking chamber G forms a continuous plane.

Figure 4:
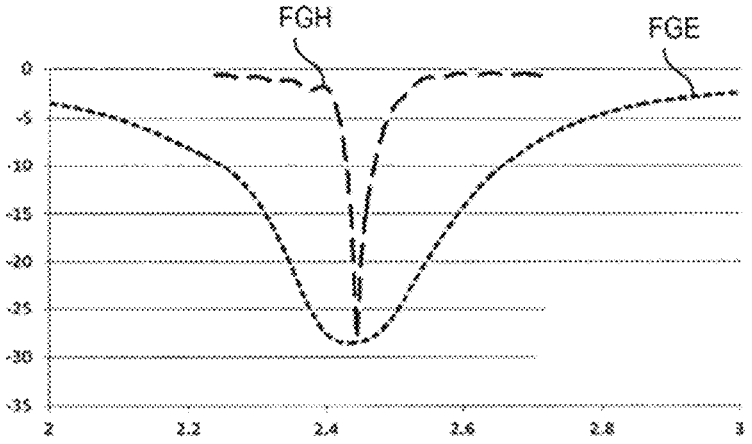
FIG. 4 shows a frequency response curve of the patch antenna.

FIG. 4 shows a frequency response curve FGE of the patch antenna 2 with a reflection factor |11| in dB plotted on the y-axis against a frequency in GHz on the x-axis. The frequency response curve FGE has a much wider band than a frequency response curve FGH of a conventional patch antenna. Both frequency response curves FGE and FGH have an extremes for the known microwave frequency of 2.45 GHz.

Figure 5:
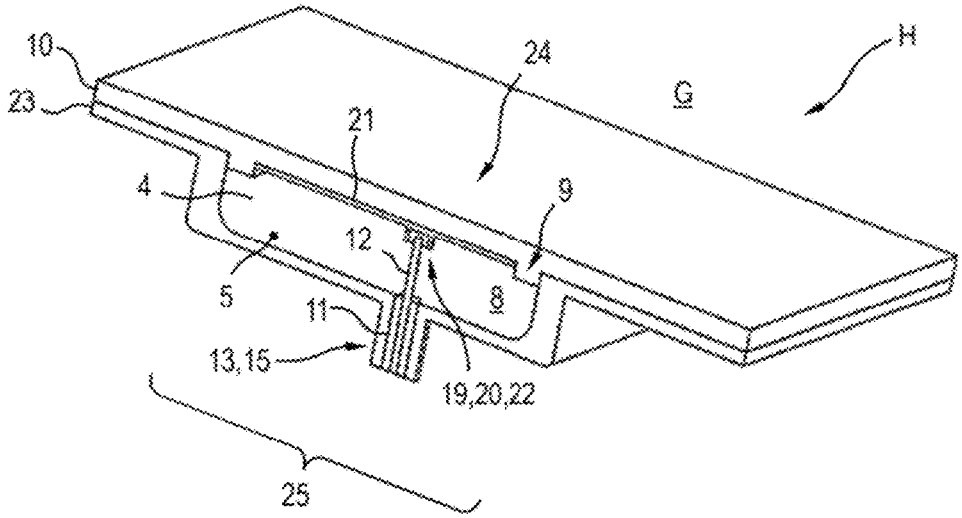
FIG. 5 shows an oblique sectional view of a detail of a cooking chamber wall in the region of a patch antenna according to a second exemplary embodiment.

FIG. 5 shows an oblique sectional view of a detail of a cooking chamber wall 23 in the region of a patch antenna 24. The patch antenna 24 has the same basic structure as the patch antenna 2. However a base body 25, the surface of which forms the recess 4 (optionally only its base 5) of the cooking chamber wall 23, has not simply been produced by removing material but by embossing and the like.

The closing material 10 now also covers the patch 21 and the cooking chamber wall 23 outside the recess 4 in the manner of a coating. A smooth layer of the closing material 10 facing the cooking chamber G is provided overall.

The patch antenna 24 can also be configured to radiate light into the cooking chamber (not shown).

The present invention is of course not limited to the illustrated exemplary embodiment.

Generally "one", etc. can refer to one or a number, in particular in the sense of "at least one" or "one or more", unless this is specifically excluded, for example by the expression "just one", etc.

A number can also refer to just the cited number as well as a standard tolerance range, unless this is specifically excluded.

LIST OF REFERENCE CHARACTERS

1 Cooking chamber wall
2 Patch antenna
3 Base body
4 Recess
5 Base
6 Patch
7 Top face
8 Hollow space
9 Annular gap
10 Closing material
11 Coaxial line
12 Inner conductor
13 Hole
14 Rear face of patch
15 Dielectric material
16 LED
17 LED
20 Holding region
19 Intermediate space
20 Dielectric material
21 Patch
22 Holding region
23 Cooking chamber wall
24 Patch antenna
25 Base body
FGE Frequency response curve
FGH Frequency response curve
G Cooking chamber
H Household cooking appliance
L Light

The invention claimed is:

1. A microwave cooking appliance, comprising:

a cooking chamber delimited by a cooking chamber wall; and a microwave apparatus configured to introduce microwaves into the cooking chamber, said microwave apparatus including a patch antenna having a planar base body and a planar emission body, which are electrically insulated from one another, said emission body configured to cover the base body at a distance and capable of being fed with microwave energy, said base body corresponding to a region of the cooking chamber wall, wherein the base body corresponds to a recess in the cooking chamber wall, said emission body being inserted into the recess, with the base body and the emission body being insulated electrically from one another by a peripheral gap, and an electrically insulating closing material configured to close the peripheral gap.

2. The microwave cooking appliance of claim 1, wherein the electrically insulating closing material covers the emission body and the peripheral gap on a side of the cooking chamber.

3. The microwave cooking appliance of claim 1, wherein the electrically insulating closing material is glass or glass ceramic.

4. The microwave cooking appliance of claim 1, wherein the electrically insulating closing material is light-permeable, and further comprising a light source to emit light such as to be capable of being coupled into the electrically insulating closing material from outside the cooking chamber.

5. The microwave cooking appliance of claim 4, wherein the recess in the cooking chamber wall corresponds to a recess in a cooking chamber light.

6. The microwave cooking appliance of claim 4, wherein the patch antenna has inner surfaces configured to reflect light.

7. The microwave cooking appliance of claim 1, wherein the emission body is arranged flush with the cooking chamber wall on a side facing the cooking chamber.

8. The microwave cooking appliance of claim 1, wherein the microwave apparatus includes a microwave supply, which is coupled capacitively to the emission body.

9. The microwave cooking appliance of claim 8, wherein the microwave supply is a coaxial line.

10. The microwave cooking appliance of claim 9, wherein the coaxial line includes an inner conductor inserted freely into a sleeve-type holding region of the emission body, and further comprising a dielectric material filling an intermediate space between the inner conductor and the sleeve-type holding region.

11. The microwave cooking appliance of claim 1, further comprising a number of said patch antenna arranged on the cooking chamber wall and aligned with different rotations from one another.

12. The microwave cooking appliance of claim 11, wherein the number of patch antennas are arranged on a side of the cooking chamber wall.

* * * * *